US005821907A

United States Patent [19]

Zhu et al.

[11] Patent Number: 5,821,907

[45] Date of Patent: Oct. 13, 1998

[54] ANTENNA FOR A RADIO TELECOMMUNICATIONS DEVICE

[75] Inventors: Lizhong Zhu, Waterloo; Yihong Qi, Hamilton; Perry Jarmuszewski, Guelph; Peter J. Edmonson, Hamilton; Steven Carkner, Waterloo, all of Canada

[73] Assignee: Research In Motion Limited, Waterloo, Canada

[21] Appl. No.: 611,386

[22] Filed: Mar. 5, 1996

[51] Int. Cl.[6] ..... H01Q 1/24; H01Q 1/50

[52] U.S. Cl. ..... 343/906; 343/749; 343/762

[58] Field of Search ..... 343/702, 906, 343/901, 900, 749, 750, 745, 722, 715

[56] References Cited

U.S. PATENT DOCUMENTS

| | | | |
|---|---|---|---|
| 4,024,542 | 5/1977 | Ikawa et al. | 343/702 |
| 4,504,834 | 3/1985 | Garay et al. | 343/749 |
| 4,750,195 | 6/1988 | Phillips et al. | 343/792 |
| 4,839,660 | 6/1989 | Hadzoglou | 343/715 |
| 4,847,629 | 7/1989 | Shimazaki | 343/901 |
| 4,857,939 | 8/1989 | Shimazaki | 343/715 |
| 4,890,114 | 12/1989 | Egashira | 343/702 |
| 5,214,434 | 5/1993 | Hsu | 343/702 |
| 5,218,370 | 6/1993 | Blaese | 343/702 |
| 5,347,291 | 9/1994 | Moore | 343/749 |
| 5,422,651 | 6/1995 | Chang | 343/749 |
| 5,451,968 | 9/1995 | Emery | 343/749 |

FOREIGN PATENT DOCUMENTS

| | | | |
|---|---|---|---|
| 55-147806 | 11/1980 | Japan | 343/702 |
| 5-129816 | 5/1993 | Japan | H01Q 1/24 |
| 5-267916 | 10/1993 | Japan | H01Q 1/24 |

OTHER PUBLICATIONS

Microwave Journal, May 1984, p. 242, advertisement of Solitron/Microwave, XP002032716 various RF connectors with posts see left hand column.

*Primary Examiner*—Hoanganh T. Le
*Attorney, Agent, or Firm*—Jones, Day, Reavis & Pogue; Charles B. Meyer, Esq.

[57] ABSTRACT

A radio telecommunications antenna includes a telescoping antenna portion for substantially receiving an electromagnetic signal. The telescoping portion is attached by an antenna mast for conducting the electromagnetic signal. A dielectric spacer and an inductor are in electrical contact with the antenna mast. An RF connector is in electrical contact with the dielectric spacer, opposite the antenna mast, so as to form a capacitor. The RF connector is also in electrical contact with the inductor so that the capacitor and the inductor form an LC circuit with values selected to provide a predetermined impedance match with the remainder of the antenna.

18 Claims, 2 Drawing Sheets

ANTENNA FOR A RADIO TELECOMMUNICATIONS DEVICE

BACKGROUND OF THE INVENTION

The present invention is directed to the field of antennas used for radio telecommunications equipment, particularly those used to transmit and receive a digital signal, e.g. modems and the like. There has been a proliferation in recent years in the field of radio telecommunications with items such as pagers along with cordless and cellular telephones becoming commonplace items. Radio modems are also coming into use which transmit data using a digitally modulated signal. With such devices, it is very important to maintain a clear, strong signal which preserves the integrity of the data transmission.

The various antennas used with existing radio modems suffer from a number of disadvantages. Previous radio modem antennas typically suffer from low gain, resulting in a shorter operating radius and also poor in-building performance, thus seriously limiting the usefulness of the radio modem.

Previous radio modem antennas are also sensitive to the presence of a human operator. The human body inherently retains a quantity of charge and thus behaves as a capacitor. When a person moves close to the antenna, their inherent capacitance affects the antenna current distribution, lowering the gain and detuning the antenna circuit. This phenomenon is called "parasitic capacitance" and is also caused by the presence of certain objects (e.g. metallic bodies) and also various ground plane conditions.

Previous radio modem antennas are also large and unwieldy, thus reducing the portability of the device. Also, previous antennas are fixedly mounted, having no structures to allow for variations in the operating angle. In these ways, the antennas of previous systems do not provide the reliable and efficient operation necessary for the transmission and reception of a digital signal.

SUMMARY OF THE INVENTION

In view of the difficulties and drawbacks associated with previous antennas, it would be advantageous to provide an antenna which solves the previous problems while providing a more reliable and efficient antenna design.

Therefore, there is a need for an antenna with an increased operating radius.

There is also a need for an antenna with improved in-building performance.

There is also a need for an antenna which is less sensitive to the presence of a human operator or other source of parasitic capacitance.

There is also a need for an antenna which is small and easily stowed.

There is also a need for an antenna with a wide range of directional positionability.

These needs and others are realized by the radio telecommunications antenna of the present invention which includes an antenna portion for substantially receiving an electromagnetic signal. The antenna portion is attached by an antenna mast for conducting the electromagnetic signal. A dielectric spacer and an inductor are in electrical contact with the antenna mast and respectively in parallel with each other. An RF connector is in electrical contact with the dielectric spacer, opposite the antenna mast, so as to form a capacitor. The RF connector is also in electrical contact with the inductor so that the capacitor and the inductor form an LC circuit with values selected to provide a predetermined impedance match with the remainder of the antenna.

As will be appreciated, the invention is capable of other and different embodiments, and its several details are capable of modifications in various respect, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein.

DETAILED DESCRIPTION OF THE INVENTION

Figure 1:
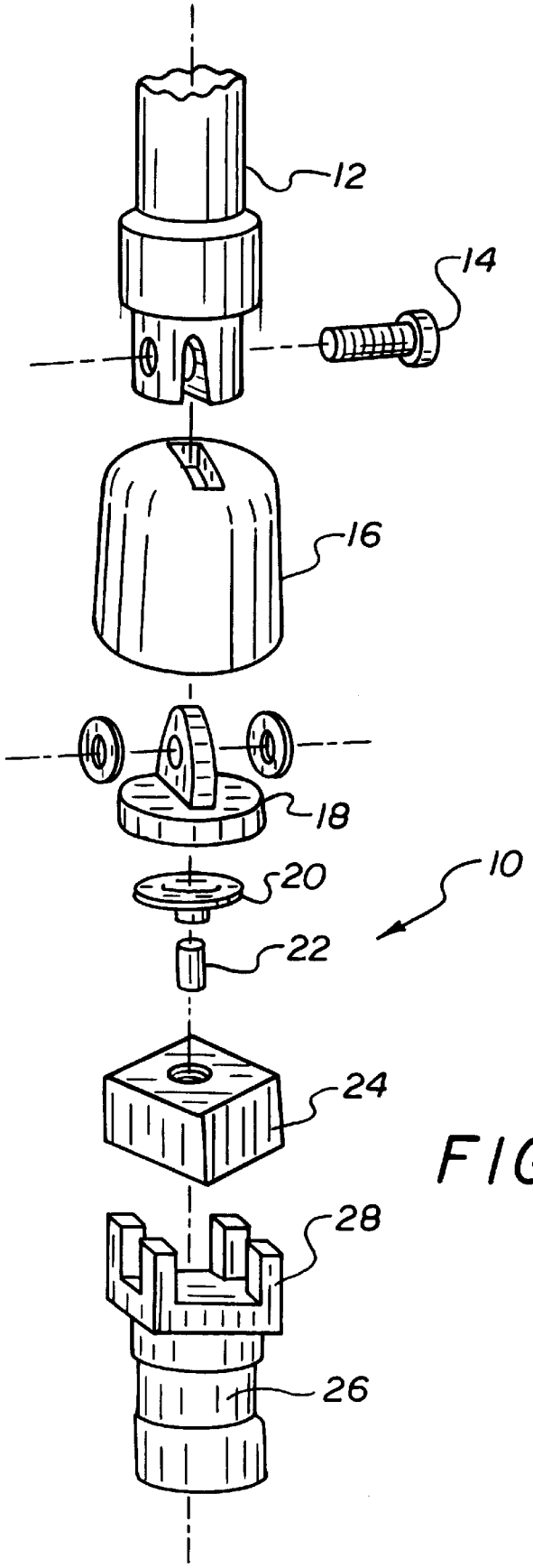
FIG. 1 is an exploded view illustrating the components and configuration of an antenna circuit as according to a preferred embodiment of the present invention.

Referring now to the drawings which are for purposes of illustrating only the preferred embodiment of the present invention and not for purposes of limiting the same, the figures show a monopole antenna having an LC impedance-matching circuit. The present antenna is especially suited for transmitting and receiving at 400 to 1000 MHz and can be collapsed down to store within a modem case that is suitable for inserting within a standard PCMCIA (Personal Computer Memory Card Interface Association) slot.

Figure 2:
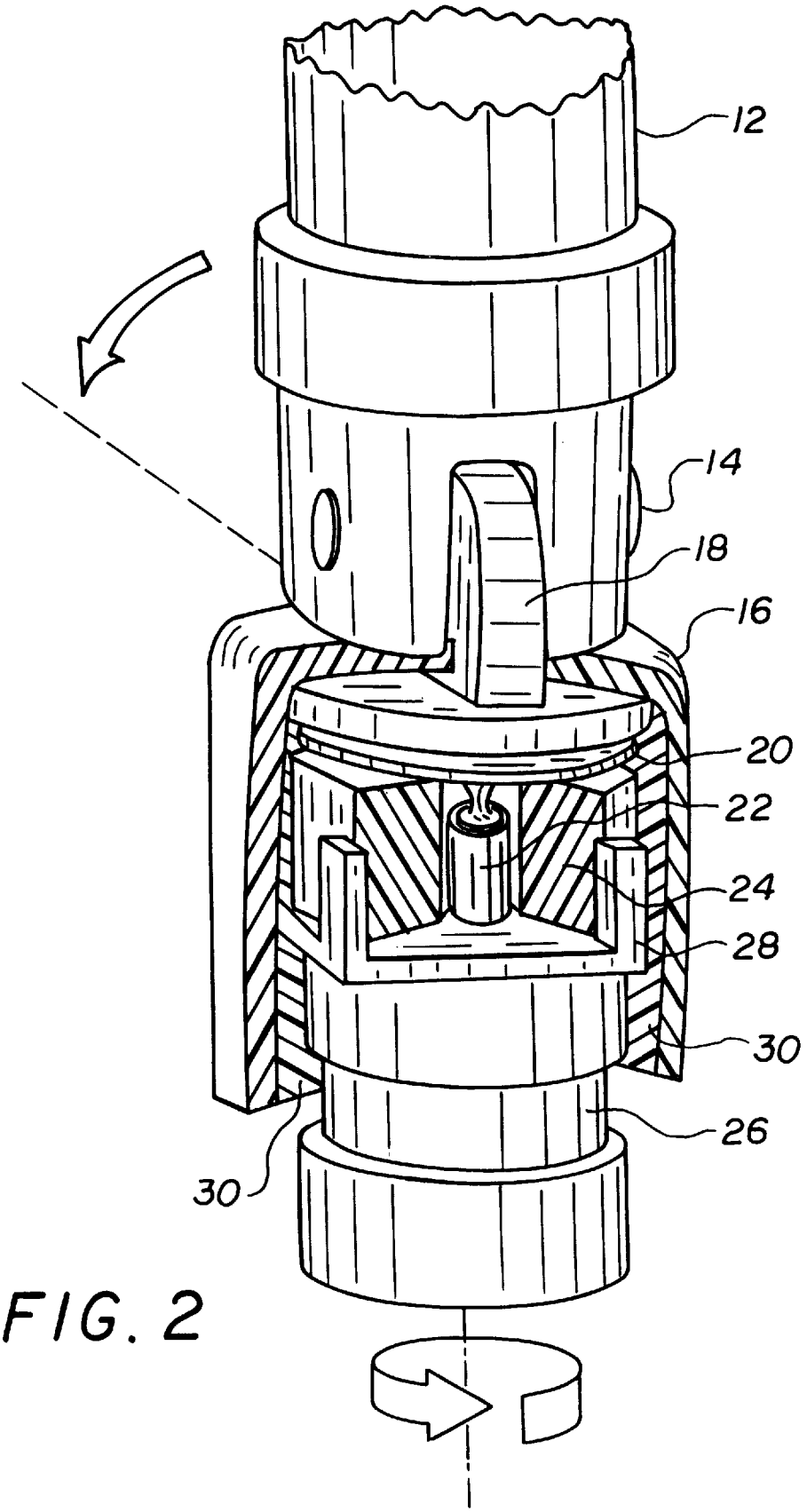
FIG. 2 is a sectional view illustrating the configuration of the assembled antenna circuit as according to a preferred embodiment of the present invention.

Turning specifically to FIGS. 1 and 2, the LC antenna 10 of the present invention includes a telescoping portion 12 for transmitting and receiving the electromagnetic signal. The telescoping portion 12 is preferably about six (6) cm. long in its storage position and can preferably be extended to about 16 cm. long in its fully-extended operating position. The telescoping portion is secured to an antenna mast, preferably a metal hinge 18 with a screw 14 and accompanying washers. The hinge 18 extends upwards through a plastic housing 16 which retains and protects the entire assembled component.

The hinge 18 is in contact with a copper spring 20 which applies sufficient force to maintain electrical contact through the hinge 18 to the telescoping portion 12. The spring 20 is in contact with an inductor 22 and a dielectric spacer 24. The spacer 24 preferably has a square shape with a central hole and retains the inductor 22 therein as a"lumped" element. The inductor 22 and the spacer 24 are in electrical contact with an RF connector 26 which receives the signal conducted through the antenna 10. The RF connector 26 is connected to the radio modem assembly and communicates the signal therethrough. Upon assembly, the base of the assembled antenna 10 is secured with dielectric epoxy 30 which holds the components in place against mechanical disassembly.

The RF connector 26 includes a plurality of posts 28, preferably four. These posts 28 serve to retain the dielectric spacer 24 in a secure interference fit. The RF connector 26 and the metal hinge 18 both have metallized surfaces which thereby define a capacitor with the dielectric spacer 24 and the dielectric epoxy 30. The spacer 24 is made of a glass-filled nylon material having a dielectric constant of about 4. The epoxy 30 is made from a polymer material having a dielectric constant of about 4. These materials provide a capacitor with a desired capacitance.

The capacitor formed by the hinge-spacerepoxy-connector sandwich is retained with the inductor 22 so as to form an LC circuit which matches the impedance of the antenna 10 to the radio modem. The metallic posts 28 of the RF connector 26 provide additional capacitance to the capacitor. The capacitance can be primarily adjusted by trimming the lengths of the posts 28, which can be trimmed to tolerances of a couple thousandths of an inch. The capacitance can also be secondarily varied by changing the material of the housing 16, the spacer 24 or the epoxy 30. In this way, the capacitance can be varied to a very precise degree. The inductor 22 is preferably a small, high permeability component such as Toko LL 1608-F22NV, which has a constant inductance of 22 nanohenrys.

By varying the capacitance, the impedance of the antenna 10 can thus be adjusted to match the measured impedance of the modem. For example, for a 50 ohm radio modem, the impedance of the antenna can be tuned to 50 ohm. This impedance matching significantly improves the antenna gain by reducing internal signal reflections in the circuit. In the radiating mode, the present antenna transmits nearly all the radiant signal, reflecting very little, as compared with previous systems which lose as much as half to reflection, transmitting a signal only half the strength of that generated by the modem. Thus, the present antenna offers a significant improvement in gain, greatly increasing the effective operating radius and improving in-building performance.

Another benefit of the present invention is that the matching circuit is quite small and compact. This reduces the susceptibility of the antenna to detuning due to parasitic capacitance. The present antenna can function satisfactorily in close proximity to a body, unlike the antennas used with previous systems.

In addition to the above advantages, the present antenna is small and easily collapsible, allowing easy storage when not in use. Also, when mounted the antenna can pivot between 0 and 90 degrees off the vertical plane and also rotate through 360 degrees.

As described hereinabove, the present invention solves many problems associated with previous antennas, and presents improved efficiency and operability. However, it will be appreciated that various changes in the details, materials and arrangements of parts which have been herein described and illustrated in order to explain the nature of the invention may be made by those skilled in the art within the principle and scope of the invention as expressed in the appended claims.

What is claimed:

1. An antenna for a radio telecommunications device having components comprising:

an antenna portion;

an electrically conductive element in electromagnetic contact with to the antenna portion;

a dielectric spacer in electromagnetic contact with the electrically conductive element;

an inductor in electromagnetic contact with the electrically conductive element, and in electromagnetic contact with said dielectric spacer; and an RF connector in electromagnetic contact with said dielectric spacer, such that the electrically conductive element, the dielectric spacer, and the RF connector are components that form a capacitor, wherein the capacitor and the inductor are connected to form an LC circuit, wherein the RF connecter includes a plurality of posts which secure the dielectric spacer and increase the capacitance of the capacitor.

2. The antenna of claim 1 wherein the posts are trimmed to desired lengths so as to adjust the capacitance of the capacitor, in order to provide impedance matching to reduce parasitic capacitance.

3. The antenna of claim 2 wherein there are four posts.

4. The antenna of claim 3 wherein the values of the inductor and the components of the capacitor are selected so as to provide an antenna circuit with an impedance that matches that of the radio telecommunications device.

5. The antenna of claim 1 wherein the values of the inductor and the components of the capacitor are selected so as to provide an antenna circuit with an impedance that matches that of the radio telecommunications device.

6. An antenna for a radio telecommunications device having components comprising:

an antenna portion for substantially receiving an electromagnetic signal:

an LC circuit comprising a capacitor and an inductor, wherein the capacitor comprises:

an electrically conductive element connected to the antenna portion;

a dielectric spacer in electromagnetic contact with the electrically conductive element;

an RF connector in electromagnetic contact with said dielectric spacer;

wherein the inductor is in electromagnetic contact with the electrically conductive element and in electromagnetic contact with said dielectric spacer, so as to form an LC circuit with capacitance and inductance selected to provide impedance matching between the antenna portion and the radio telecommunications device.

7. The antenna of claim 6 wherein the inductor is received within a hole in the dielectric spacer.

8. The antenna of claim 6 further including a spring which applies a mechanical securing force to retain the dielectric spacer and the inductor in contact between the electrically conductive element and the RF connector.

9. The antenna of claim 8 wherein the electrically conductive element is the combination of the spring in contact with a hinge element.

10. The antenna of claim 6 wherein the antenna portion comprises a telescoping portion which can be varied between minimum and maximum extendible lengths.

11. The antenna of claim 10 wherein the extendible length of the telescoping antenna portion is between six and sixteen cm.

12. The antenna of claim 6 further comprising a housing for receiving and securing the components of the antenna into an assembled unit.

13. The antenna of claim 12 wherein the components of the antenna are secured with a dielectric epoxy that provides the capacitor with additional capacitance.

14. The antenna of claim 12 wherein the antenna portion is pivotable with 360 degrees of rotation.

15. The antenna of claim 6 wherein the components of the antenna are secured with a dielectric epoxy which provides additional capacitance to the capacitor.

16. The antenna of claim 6 wherein the components of the antenna are compact, thereby reducing the effect of parasitic capacitance.

17. The antenna of claim 6 wherein the electrically conductive element is a hinge.

18. The antenna of claim 17 wherein the hinge permits the antenna portion to be pivoted between 0 and 90 degrees to the vertical.

* * * * *